United States Patent [19]

Miyaguchi et al.

[11] Patent Number: 4,771,725

[45] Date of Patent: Sep. 20, 1988

[54] PUSH BUTTON INDICATING DEVICE

[75] Inventors: Hiroyuki Miyaguchi; Soetsu Kamada, both of Furukawa, Japan

[73] Assignee: Alps Electric Co., Ltd., Japan

[21] Appl. No.: 9,284

[22] Filed: Jan. 30, 1987

[30] Foreign Application Priority Data

Apr. 30, 1986 [JP] Japan ..... 61-64019[U]

[51] Int. Cl.[4] ..... G09F 9/00; H01H 9/16

[52] U.S. Cl. ..... 116/279; 116/DIG. 28; 200/314

[58] Field of Search ..... 116/279, 306, 307, 313, 116/202, DIG. 28; 200/309–316

[56] References Cited

U.S. PATENT DOCUMENTS

| | | | |
|---|---|---|---|
| 2,440,063 | 4/1948 | Andrews | 200/314 |
| 3,213,269 | 10/1965 | Melvin et al. | 362/293 |
| 3,619,591 | 11/1971 | Korski | 116/279 |
| 3,780,248 | 12/1973 | Martin | 116/DIG. 28 |
| 3,895,204 | 7/1975 | Lewis | 200/314 |
| 4,395,611 | 7/1983 | Kondo et al. | 200/314 |

*Primary Examiner*—William A. Cuchlinski, Jr.
*Assistant Examiner*—W. Morris Worth
*Attorney, Agent, or Firm*—Guy W. Shoup; Paul J. Winters; Leighton K. Chong

[57] ABSTRACT

In a push button indicating device including a first slide member having an operational portion formed with an indicating portion on a front surface thereof, a second slide member slidably supported to the first slide member and having a substantially sectional L-shaped rotational member rotatably mounted on the side of the indicating portion, the rotational member having a light transmitting plate and a light shielding plate, a frame for slidably supporting the first slide member, and a lock for restricting a sliding position of the first slide member, wherein at least two positions of the first slide member are selected between a depressed position where the light transmitting plate faces the indicating portion and an undepressed position where the light shielding plate faces the indicating portion; the improvement comprises a light guiding member provided in the second slide member for guiding light to the rotational member, and a light transmitting hole formed through at least both of the first slide member and the frame for forming a light path leading to the light guiding member when the first slide member is in the undepressed position.

5 Claims, 5 Drawing Sheets

PUSH BUTTON INDICATING DEVICE

BACKGROUND OF THE INVENTION

The present invention relates to a push button indicating device suitable for a push operating member of passive parts such as a push button switch.

Conventionally, various types of indicating means have been used to indicate an operational position of an operating portion of the passive parts. In a rotary type, the operating portion is generally provided at its outer periphery with a mark such as a projection or a line, so that the operational position may be perceived from a change in an angle of the mark relative to the body of the passive parts. In a sliding type, the operating portion is provided at its part with a mark similar to the above, so that a change in a position of the mark relative to the body of the passive parts may be perceived. In a push type, it is difficult to judge whether the operating portion is in a depressed position or an undepressed position when an operator looks at the operating portion from a front side thereof. Therefore, in a push button switch for example, the operating portion itself or a lamp provided near the operating portion is generally designed to turn on in the depressed position of a push button to thereby indicate an on-state of the push button. An example of this push button switch is disclosed in Japanese Laid-Open Utility Model Publication No. 55-151987 by the common applicant.

FIG. 6 is a sectional view of an essential part of the lighted push button switch disclosed in the above cited reference. The push button switch includes a light transmissible cap 1 made of synthetic resin acting as a push member, a light transmissible indicator plate 2, a front plate 3, an operational member 4, a rotational member 6 having rotary plates 7 and 8, a cover 9, a lamp 10, a coil spring 11, a switch 12, a return spring 13 for the switch 12, an arm 14 and a coil spring 15 for biasing the arm 14 rightward.

The cap 1 is formed with a through-hole 1*c* a front surface 1*a* and with a recess 1*b* just inside the through-hole 1*c*. As shown in FIG. 7, an illustrated indication for function or kind is formed on an upper half of the front surface 1*a*.

The indicator plate 2 includes a flat portion 2*a* engaged with the recess 1*b* of the cap 1, an projected indicating portion 2*b* inserted into the through-hole 1*c* of the cap 1, a support portion 2*d* formed at right angles to the flat portion 2*a* and extending along a side wall of the cap 1, and a tongue portion 2i c projected in a L-shape from the end of the support portion 2*d*. The tongue portion 2*c* is adapted to abut against the rotary plate 7 or 8 to rotate the same. A distance between the tongue portion 2*c* and the flat portion 2*a* is larger than a radius of rotation of the rotary plate 7.

The front plate 3 is formed with an angular cylindrical through-hole 3*a* and with a projecting portion 3*b* projecting from an intermediate position of one side surface and extending rearward (leftward as viewed in FIG. 6). The projecting portion 3*b* is formed with a shoulder portion 3*c* having an inside recess 3*d* and an outside recess 3*e*, and with an engagement portion 3*f* adapted to engage with the arm 14 in cooperation with the recess 3*e*.

The operational member 4 is of an angular cylinder to be inserted into the through-hole 3*a* of the front plate 3. The operational member 4 is formed with an operational arm 4*a* projecting from a side wall of a rear end portion thereof in such a manner as to be opposed to the shoulder portion 3*c* of the front plate 3. A partition wall 4*c* partitioning an opening portion 4*b* of the operational member 4 into upper and lower opening sections extends from the front end to the substantially central portion of the operational member 4. A side wall of the lower opening section 4*pposite* the partition wall 4*c* is cut away to a nearly central position thereof.

The rotational member 6 is of a substantially sectional L-shape such that the rotary plate 7 of a light transmissible material is arranged at right angles to the rotary plate 8 of a light shieldable material. The rotational member 6 is supported by support shafts 6*a* inserted into a right-angular portion from both sides thereof.

The cover 9 is formed with a recess 9*b* communicated with the through-hole 3*a* of the front plate 3, and with a switch mounting hole 9*c* opposed to the projecting portion 3*b* of the front plate 3.

The lamp 10 as a light source is fitted with a hole 9*a* formed through a botton portion of the recess 9*b*. The cover 9 and the front plate 3 is formed with any suitable connecting means (not shown) such as a screw connecting portion or a snap-in connecting portion to be thereby connected with each other.

The coil spring 11 is located between the recess 3*d* and the operational arm 4*a* to normally bias the operational member 4 and prevent undue play.

The push button switch 12 including a self-lock mechanism is provided with a terminal plate 12*a* and an operational rod 12*b*. A spring pressure of the coil spring 13 is greater than that of the coil spring 11.

The arm 14 is formed with an engagement portion 14*a* engaged with the engagement portion 3*f* of the front plate 3, and is formed with a side plate 14*c* projecting into the opening portion 4*d* of the operational member 4 in such a manner as to be stepped up from the engagement portion 14*a*. The engagement portion 14*a* is provided at its rear portion with a stopper 14*b* abuttable against the engagement portion 3*f*, and is further provided at its rear end with a projection 14*e*. Side surfaces of the side plate 14*c* extend to the front side to form lug portions 14*f* of a small width. The lug portions 14*f* are formed at their end portions with engagement holes 14*d* engaged with the support shafts 6*a* of the rotational member 6. The coil spring 15 serving to bias the arm 14 frontward (rightward) is located between the arm 14 and the recess 3*e*.

The self-lock mechanism of the switch 12 is such that when the push rod 12*b* is depressed, it is locked in a depressed position, and is restrained from being returned to an initial position even after a depression force is removed. When the push rod 12*b* is depressed again, and the depression force is removed, the locked condition is released to let the push rod 12*b* be returned to the initial position.

The operation of the conventional switch will be set forth below. First, the switch 12 is operated in the following manner. When the cap 1 is depressed, the operational member 4 is moved rearward (leftward as viewed in FIGS. 6 to 10). As shown in FIG. 10, the push rod 12*b* is fully depressed to be locked, and when the depression force is removed, the push rod 12*b* is slightly moved reversely, and is retained in the locked position shown in FIG. 9. At this time, a contact provided in the switch 12 is switched on, and is retained in the on-state. Next, when the cap 1 of FIG. 9 is depressed to the position shown in FIG. 10, the push rod 12*b* locked is unlocked, and when the depression force is removed, the push rod 12*b* is returned to the initial position shown in FIG. 6.

During the course of the above operation of the switch 12, the indicating position 2*b* is changed as follows:

In the undepressed position of the cap 1, the indicating portion 2*b* is opposed to the light shielding rotary plate 8. When the cap 1 is depressed, the tongue portion 2*c* is separated from the rotary plate 7 to abut against the rotary plate 8. Then, the rotational member 6 starts rotating as shown in FIG. 8. When the cap 1 is further depressed, the rotary plate 7 is rotated to the position opposite to the indicating portion 2*b*, whereby the indicating portion 2*b* is brightened by the light emitting through the rotary plate 7. That is, the opening portion 4*b* of the operational member 4 is partitioned substantially equally into upper and lower halves by the partition wall 4*c*, and the rotational member 6 is located in the lower half of the opening portion 4*b*. Accordingly, an upper half of the front surface 1*f* cap 1 is illuminated by the light from the lamp 10, thereby allowing the illustrated indication to be perceived, while a lower half of the front surface 1*a*, that is, the indicating portion 2*b* is lightened according to the depressed position of the cap 1, that is, the operational condition of the push button switch 12.

However, in the push button switch as mentioned above, the lamp 10 is mounted in each of the switches. Therefore, in the cases that like push button switches are arranged, or any other equipment including lighting parts are arranged in association, the number of the lamp 10 is increased to increase costs of parts and an amount of heat generated. As a result, the push button, that is, the cap 1 becomes hot.

To cope with this problem, it is considered that the light sources such as the lamp 10 are located outside the push button switch, and the light from the light sources is guided through a light guiding member to the opening portions 4*b* and 4*d* of each of the operational members 4, thereby lighting desired portions. That is, in the prior art employing the light sources located on the back side of the operational members 4 and at the position relatively near the rotational members 6, it is not especially necessary to use the light guiding member. To the contrary, when the light sources are located outside the push button switch, attenuation of the light is remarkable, and accordingly, it is necessary to use the light guiding member to thereby guide the light to the rotational members 6. Thus, the use of the light guiding member enables diffusion of the light to be suppressed at the minimum, thereby guiding the light of high luminance to the rotational members 6. However, in the aforementioned push button switch using the rotational member 6 to transmit or shield the light according to the depressed or undepressed position of the cap 1, if the luminance of the light guided by the light guiding member is intensive, there is a possibility that the light leaks from the periphery of the light shieldable rotary plate 8 of the rotational member 6 to undesirably lighten the indicating portion 2*b*.

In other words, if the luminance of the light guided by the light guiding member is intensive, the indicating portion 2*b* is brightly illuminated. Therefore, even in the undepressed position of the cap 1, the indicating portion 2*b* tends to be brightened. As a result, the undepressed position cannot be visually distinguished from the depressed position.

SUMMARY OF THE INVENTION

It is an object of the present invention to provide a push button indicating device which may reliably block a light path leading to the indicating portion when indication is unnecessary, and may provide bright indication with good visibility only when the indication is necessary.

According to the present invention, in a push button indicating device including a first slide member having an operational portion formed with an indicating portion on a front surface thereof, a second slide member slidably supported to the first slide member and having a substantially sectional L-shaped rotational member rotatably mounted on the side of the indicating portion, the rotational member having a light transmitting plate and a light shielding plate, a frame for slidably supporting the first slide member, and lock means for restricting a sliding position of the first slide member, wherein at least two positions of the first slide member are selected between a depressed position where the light transmitting plate faces the indicating portion and an undepressed position where the light shielding plate faces the indicating portion; the improvement comprises a light guiding member provided in the second slide member for guiding light to the rotational member, and a light transmitting hole formed through at least both of the first slide member and the frame for forming a light path leading to the light guiding member when the first slide member is in the undepressed position.

With this arrangement, the light from a light source provided outside the device is introduced from the light transmitting hole to provide indication according to the position of a push button. The position of the light guiding member relative to the light transmitting holes is changed between in the depressed position and in the undepressed position of the first slide member. In the depressed position where the indication is necessary, the light from the external light source is guided through the light transmitting holes to the light transmitting plate of the rotational member. In the undepressed position where the indication is unnecessary, the light transmitting holes are closed to hinder the light from entering the light guiding member. Therefore, there is no possibility that leakage of the light from the indicating portion is generated in the undepressed position.

Other objects and features of the invention will be more fully understood from the following detailed description and appended claims when taken with the accompaning drawings.

DETAILED DESCRIPTION OF THE PREFERRED EMBODIMENT

Figure 1:
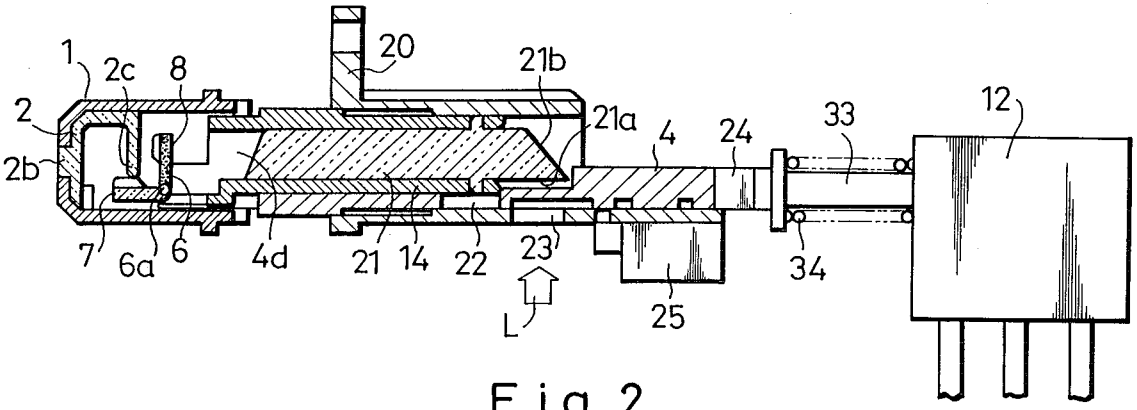
FIGS. 1 to 3 are partially sectional views of the push button indicating device of a preferred embodiment according to the present invention, showing the operation of the device.

Referring to FIGS. 1 to 5 which show a preferred embodiment of the present invention, wherein the same or corresponding parts as in the aforementioned prior art are designated by the same reference numerals, the push button indicating device is primarily constituted of an operational member 4 as a first slide member with which a cap 1 as an operating portion is engaged, an arm 14 as a second slide member slidably mounted on the operational member 4 which arm 14 is provided with a rotational member 6 on the cap 1 side and with a light guiding member 21 on the rotational member 6 side, and a frame 20 for slidably supporting the operational member 4. The push button indicating device is connected through a connecting portion 24 to a switch 12 at the opposite end to the cap 1 of the operational member 4.

A transparent indicator plate 2 made of methacrylic resin for example, is mounted on the inner surface of the cap 1. The indicator plate 2 is formed with an indicating portion **2*b* exposed to the front surface of the cap 1, and with a tongue portion 2*c*** depending from an inside part in the same manner as in the prior art.

Figure 4:
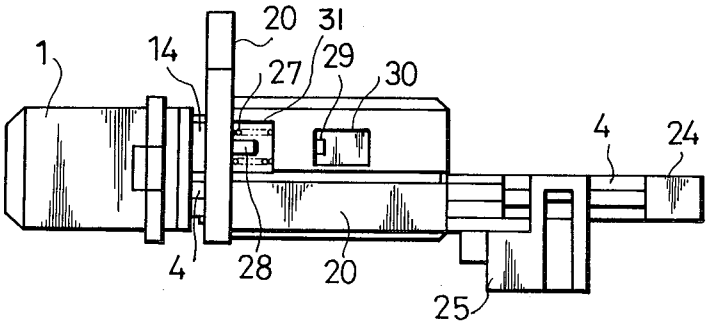
FIG. 4 is a side view of the device.
Figure 5:
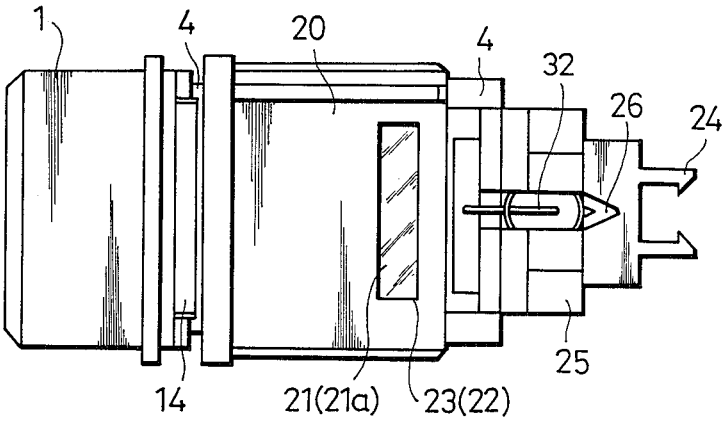
FIG. 5 is a botton plan view of the device.
Figure 6:
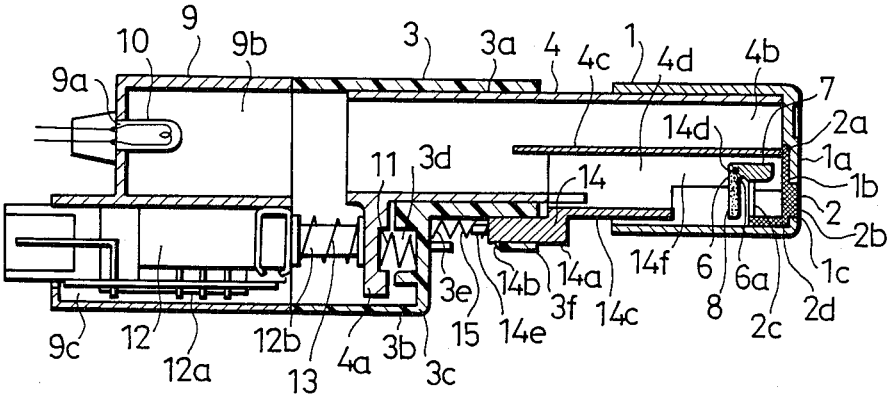
Fig. 6 PRIOR ART
FIG. 6 is a sectional view of an essential part of the push button indicating device in the prior art.
Figure 7:
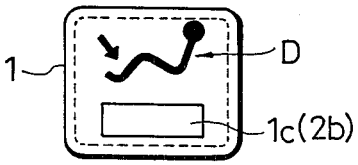
Fig. 7 PRIOR ART
FIG. 7 is an elevational view of the cap shown in FIG. 6.
Figure 8:
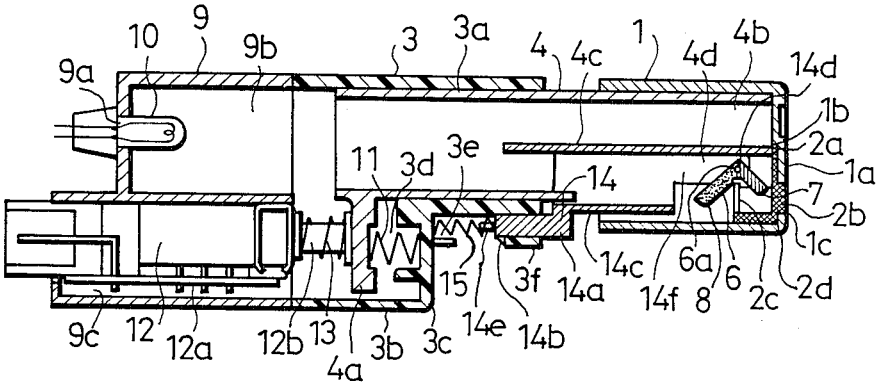
Fig. 8 PRIOR ART
FIGS. 8 to 10 are sectional views similar to FIG. 6, showing the operation of the push button indicating device.
Figure 9:
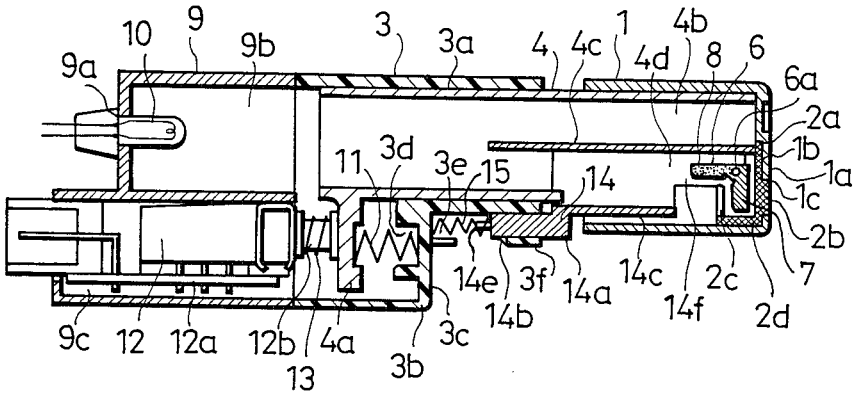
Fig. 9 PRIOR ART
Figure 10:
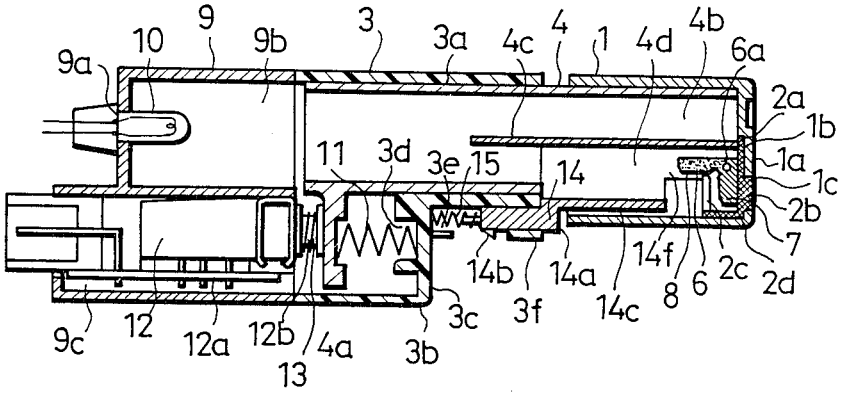
Fig. 10 PRIOR ART

The operational member 4 is slidably supported in the frame 20 of substantially angular cylinder. The cap 1 is mounted on the operating portion at the left end portion of the operational member 4 as viewed in FIGS. 1 to 5, and the connecting portion 24 of a snap fit type as shown in FIG. 5 is formed at the right end portion of the operational member 4. A heart-like cam groove 26 constituting a part of a lock mechanism to be hereinafter described is formed on the botton surface of the operational member 4 in the vicinity of the connecting member 24. A slit-like light transmitting hole 22 is formed at a predetermined position of the operational member 4 surrounded by the frame 20.

The arm 14 is provided with the rotational member 6 supported by a support shaft **6*t* front end portion (the left end portion as viewed in FIGS. 1 to 5), and with the light guiding member 21 made of methacrylic resin for example, extending from the central portion to the rear end portion. The rear end portion of the light guiding member 21 is projected from the arm 14. The lower surface of the rearward projected portion of the light guiding member 21 functions as a light introducing surface 21*a*, and the inclined surface of the rearward projected portion having a predetermined inclined angle functions as a light reflecting surface 21*b*. The front end portion of the light guiding member 21 extends to a position near the rotational member 6. The rotational member 6 consists of a rotary plate (light transmissible plate) 7 formed of light transmissible materials such as polycarbonate resin and a rotary plate (light shieldable plate) 8 formed of light shieldable materials, whereby the rotational member 6 is formed in a substantially sectional L-shape. As the rotary plate 8 merely requires a light shielding property, the rotational member 6 may be formed of a common resin, and then a film primarily containing carbon black for example may be attached on the surface of the rotary plate 8. As shown in FIG. 4, a mounting portion 28 of a coil spring 27 and a stopper 29 are provided on a side surface of the arm 14. The coil spring 27 is disposed between the mounting portion 28 and the frame 20 to normally bias the arm 14 toward the front end portion of the cap 1. The stopper 29 is designed to engage with the edge of an opening portion 30 formed through the side surface of the frame 20 to thereby restrict a position of the arm 14**.

The frame 20 has the form of substantially angular cylinder as mentioned above, and it slidably supports the operational member 4 and the arm 14 therein. As shown in FIG. 4, the frame 20 is formed on its side surface with a mounting hole 31 of the coil spring 27 and with the opening portion 30 in which the stopper 29 is loosely inserted. A slit-like light transmitting hole 23 is formed through the lower surface of the frame 20. A lock mechanism 25 is mounted on the rear portion of the frame 20 in such a manner as to project therefrom. The light transmitting hole 23 of the frame 20 has the same form as of the light transmitting hole 22 of the operational member 4. The light transmitting hole 23 is formed at a position such that it is out of communication with the light transmitting hole 22 under the undepressed condition of the operational member 4, while it is in communication with the light transmitting hole 22 under the depressed condition of the operational member 4, in consideration of a depression stroke of the operational member 4. That is, a light path leading from the light transmitting holes 23 and 22 to the light introducing surface **21*a* of the light guiding member 21** is formed under the depressed condition, while the light path is cut under the undepressed condition.

The lock means is operable in combination with the lock mechanism 25 and the cam groove 26 in a known manner. Self lock is effected at a predetermined position in the course of sliding movement of the end of a lock pin 32 in the cam groove 26.

The switch 12 is a single acting or an interlocking type switch device, for example, wherein a push rod 33 connected to a movable contact of the switch device is connected to the connecting portion 24 of the operational member 4, and the movable contact is switched by the sliding movement of the operational member 4. A coil spring 34 is fitted to the push rod 33 so as to normally bias the push rod 33 to the operational member 4 and apply a driving force to the lock mechanism 25.

The push button indicating device described above is operated as follows:

Under the undepressed condition of the operational member 4 as shown in FIG. 1, the tongue portion **2*c* of the indicator plate 2 abuts against the rotary plate 7 of the rotating member 6, and the rotary plate 8 faces to the indicating portion 2*f* the indicator plate 2. The light transmitting hole 22 of the operational member 4 is fully shifted from the light transmitting hole 23 of the frame 20 to thereby hinder light L from a light source (not shown) provided on the lower side of the operational member 4 from entering the light introducing surface 21*a* of the light guiding member 21. Accordingly, a double light shielding means for shielding light to the indicating portion 2*b* is formed by the rotary plate 8 and the operational member 4**.

Figure 2:
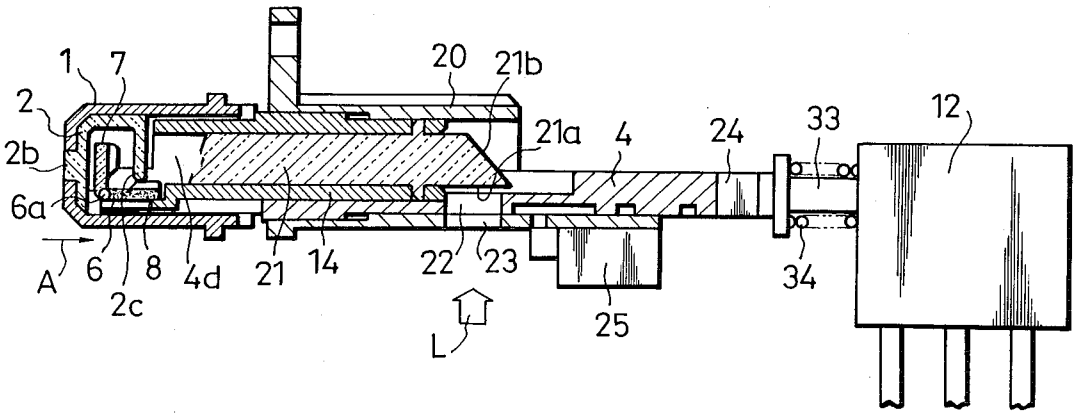
Figure 3:
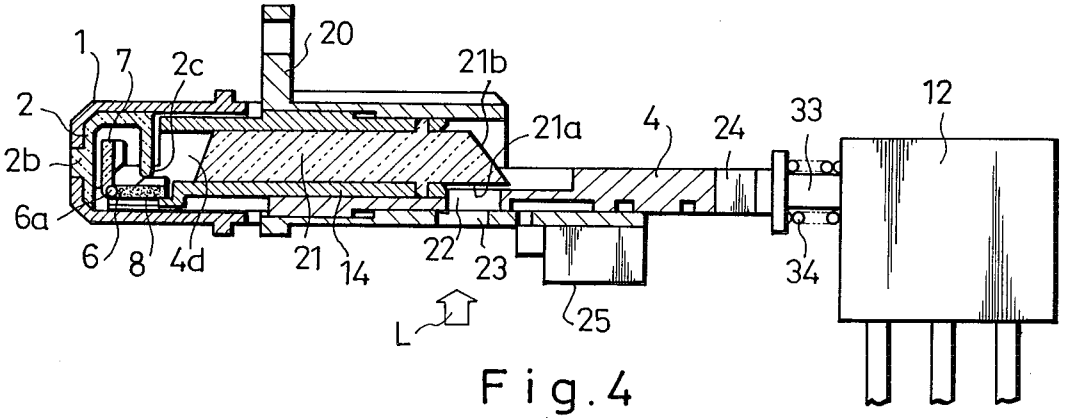

When the cap 1 is pushed in the direction as depicted by an arrow A in FIG. 2, the operational member 4 is moved in the direction A, and the tongue portion **2*c* comes to abutment against the rotary plate 8 to rotate the same clockwise and make the light transmissible rotary plate 7 in opposition to the indicating portion 2*b*. When the operational member 4 is fully depressed, the lock pin 32 is locked in the cam groove 26 as shown in FIG. 3. The depression force applied to the operational member 4** is removed to allow the operational member 4 to be slightly moved reversely and retained under the locked condition of FIG. 2. At this time, the light transmitting holes 22 and 23 are brought into coincidence with each other to form the light path leading to the light introducing surface 21*a* of the light guiding member 21. As a result, the light L from the light source is introduced through the light transmitting holes 23 and 22 to the light introducing surface 21*a*, and is reflected on the light reflecting surface 21*b*. The reflected light reaches the rotary plate 7, and passes therethrough, then emitting from the indicating portion 2*b* to the outside of the device. Under the locked condition shown in FIG. 2, the push rod 33 is forced into the switch 12 to move the movable contact and close a circuit in the switch 12. Accordingly, the indicating portion 2*b* is brightened to enable an operator to clearly confirm the operated position of the operational member 4 from the outside. Further, if the light transmissible rotary plate 7 is colored blue or red for example, visibility of the operated position will be naturally improved. Moreover, as the coil spring 27 normally biasing the arm 14 toward the cap 1 is provided to normally locate the rotary plate 7 mounted at the front end of the arm 14 in a position nearest the indicating portion 2*b*, appearance of color of the rotary plate 7 through the indicating portion 2*b* may be remarkably improved.

Next, when the cap 1 is pushed again in the direction A from the position shown in FIG. 2, the locked condition is released in the position shown in FIG. 3. Then, a depression force is removed to let the operational member 4 return to the undepressed position shown in FIG. 1. in the above course, the rotational member 6 is rotated counterclockwise from the position shown in FIG. 2 to be returned to the condition shown in FIG. 1. As a result, the light L from the light source is blocked to let the brightness of the indicating portion 2*b* disappear. Similarly, the push rod 33 is also returned to the position shown in FIG. 1 to thereby turn off the switch 12.

As is described above, the preferred embodiment of the present invention has the following advantages.

(1) As the light L is allowed to be introduced to the light guiding member 21 to enter the rotary plate 7 only when indication is necessary, clear indication may be obtained.

(2) As the arm 14 is normally biased toward the cap 1 by the coil spring 27 to provide a shortest distance between the rotary plate 7 and the indicating portion 2*b*, appearance of color of the light transmissible rotary plate 7, if colored, through the indicating portion 2*b* may be improved.

(3) As only a single light source is required even when a plurality of switches 12 are provided, power consumption and heat generation may be suppressed.

While the invention has been described with reference to a specific embodiment, the description is illustrative and is not to be construed as limiting the scope of the invention. Various modifications and changes may occur to those skilled in the art without departing from the spirit and scope of the invention as defined by the appended claims.

What is claimed is:

1. In a push button indicating device including a first slide member which is slidable in a longitudinal direction between an undepressed position and a depressed position and having a front operational portion formed with a light transmissive, indicating portion on a front surface thereof and an abutting member carried therein, a second slide member slidably supported inside said first slide member and having a rotatable, sectional L-shaped member rotatably mounted toward a front end thereof facing said indicating portion of said first slide member, said rotatable member having a light transmitting plate and a light shielding plate and being rotatably abutted by said abutting member to bring said light shielding plate facing said indicating portion when said first slide member is moved longitudinally to the undepressed position, and to bring said light transmissive plate facing said indicating portion when said first slide member is moved longitudinally from said undepressed position to said depressed position, a frame for slidably supporting said first slide member, and locking means for locking said first slide member at and for releasing it from said depressed position, the improvement wherein a light guide member is mounted in said second slide member having a front end portion facing toward said rotatable member, said frame has a light transmitting hole formed therein, said first slide member also has a light transmitting hole formed therein leading to said light guide member of said second slide member, wherein said light transmitting holes of said frame and said first slide member are positioned to substantially align with each other when said first slide member is longitudinally moved to the depressed position relative to said frame, thereby allowing transmission of light from an external source into said frame, said first slide member, and said light guide member of said second slide member, and through the light transmissive plate of said rotatable member to illuminate said indicating portion of said said first slide member at said depressed position, and conversely cutting off transmission of light to said indicating portion from the external source when said first slide member is not in said depressed position.

2. The push button indicating device as defined in claim 1, wherein a rear end portion of said light guiding member is projected from said second slide member, and a lower surface of said rear end portion forms a light introducing surface, while an inclined surface of said rear end portion having a predetermined inclined angle forms a light reflecting surface.

3. The push button indicating device as defined in claim 1, wherein a front end portion of said light guiding member extends to a position near said rotational member.

4. The push button indicating device as defined in claim 1, wherein said light transmitting hole formed through said frame has the same form as of said light transmitting hole formed through said first slide member.

5. The push button indicating device as defined in claim 1, further comprising a coil spring for normally biasing said second slide member toward said operating portion.

* * * * *